United States Patent [19]

Larson et al.

[11] Patent Number: 4,895,036

[45] Date of Patent: Jan. 23, 1990

[54] KEY

[75] Inventors: Wayne F. Larson; John J. Risko, both of Salem, Oreg.

[73] Assignee: Supra Products, Inc., Salem, Oreg.

[21] Appl. No.: 194,471

[22] Filed: May 16, 1988

Related U.S. Application Data

[63] Continuation of Ser. No. 709,583, Mar. 8, 1985, which is a continuation-in-part of Ser. No. 706,710, Feb. 27, 1985, abandoned, which is a continuation-in-part of Ser. No. 661,085, Oct. 15, 1984, abandoned.

[51] Int. Cl.[4] ..... E05B 47/06; E05B 37/00

[52] U.S. Cl. ..... 70/284; 70/366; 70/383; 70/384; 70/285

[58] Field of Search ..... 70/284, 285, 365, 366, 70/383, 384

[56] References Cited

U.S. PATENT DOCUMENTS

| | | | |
|---|---|---|---|
| 1,092,474 | 4/1914 | Carroll . | |
| 1,253,051 | 1/1918 | Knistrom . | |
| 1,389,380 | 8/1921 | Raab . | |
| 1,732,847 | 10/1929 | Katz | 70/46 |
| 1,937,523 | 12/1933 | Machinist | 70/53 |
| 2,970,466 | 2/1961 | Wellekens | 70/339 |
| 3,383,886 | 5/1968 | Hermann | 70/284 |
| 3,416,337 | 12/1968 | Hutchins | 70/284 |
| 3,438,051 | 4/1969 | De Vines . | |
| 3,548,620 | 12/1970 | Genakis | 70/366 |
| 3,555,858 | 1/1971 | Owen et al. | 70/384 |
| 3,789,638 | 2/1974 | Roberts et al. | 70/366 |
| 3,893,314 | 7/1975 | Raymond | 70/384 |
| 4,073,171 | 2/1978 | Moorhouse | 70/366 |
| 4,114,410 | 9/1978 | Astier | 70/383 |
| 4,325,240 | 4/1982 | Gable | 70/284 |
| 4,359,886 | 11/1982 | Evans et al. | 70/366 |
| 4,418,555 | 12/1983 | Uyeda | 70/366 |
| 4,455,847 | 6/1984 | Hung | 70/284 |

FOREIGN PATENT DOCUMENTS

| | | | |
|---|---|---|---|
| 144140 | 11/1951 | Australia | 70/284 |
| 1164678 | 4/1984 | Canada | 70/284 |
| 891514 | 8/1953 | Fed. Rep. of Germany | 70/366 |
| 1428526 | 11/1968 | Fed. Rep. of Germany . | |
| 2517689 | 11/1975 | Fed. Rep. of Germany | 70/366 |
| 708801 | 7/1931 | France . | |
| 1024664 | 4/1953 | France | 70/366 |
| 2436237 | 5/1980 | France | 70/284 |

OTHER PUBLICATIONS

MAC Recording Mechanical Access Control System from Supra, Supra Products, Inc., P.O. Box 3167, Salem, Oregon 97302, 10/3/1983.

The Supra Recording Key Safe MAC, Supra Products, Inc., P.O. Box 3167, Salem, Oregon 97302 (11/11/83).

*Primary Examiner*—Vinh T. Luong

*Attorney, Agent, or Firm*—Klarquist, Sparkman, Campbell, Leigh & Whinston

[57] ABSTRACT

A key for use with a lock having internally lugged tumblers comprises an elongate cylindrical member with a longitudinal keyway to receive the lugs. From the longitudinal keyway extend a plurality of circumferential grooves of coded lengths. From the ends of certain of these circumferential grooves extend second, axial grooves which extend back toward the handle of the key. These axial grooves permit the key to be pushed inwardly into the lock after the key has been fully turned. One of the circumferential grooves does not include an axial segment extending from the end thereof. This groove engages a member in the lock which is caused to move when the key is pushed inwardly after rotation. The movement of this lock member activates a printing mechanism inside the lock.

2 Claims, 7 Drawing Sheets

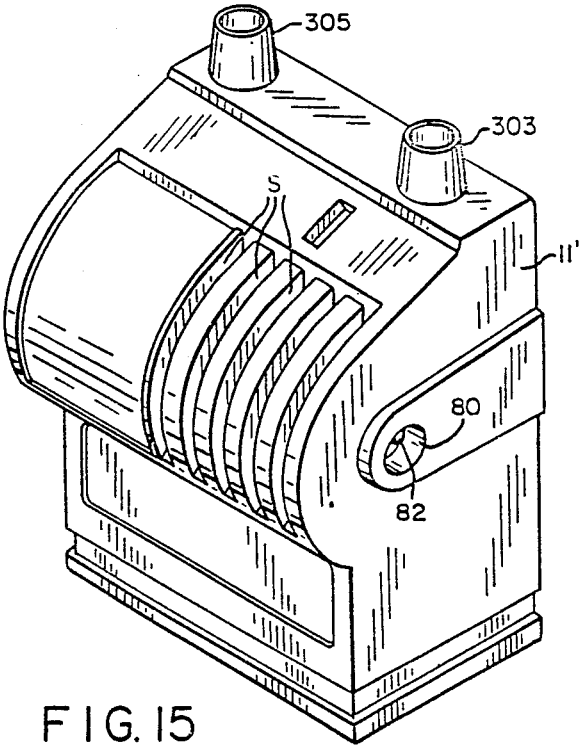
FIG. 15
FIG. 16
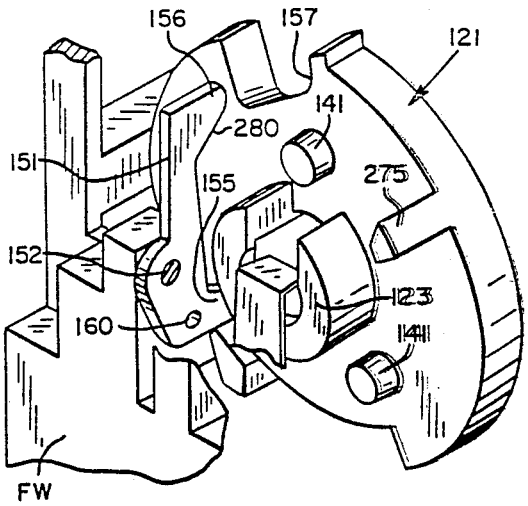
FIG. 17
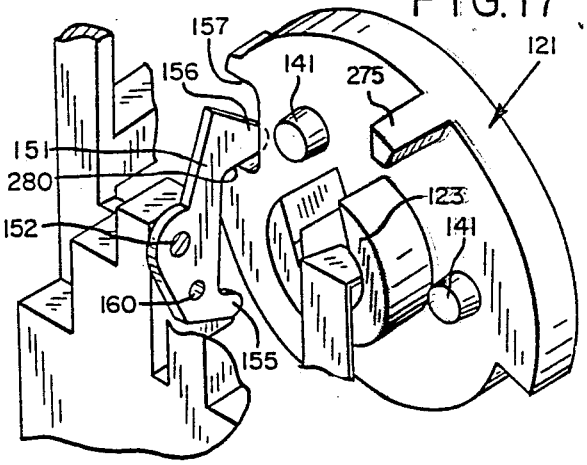
FIG. 18
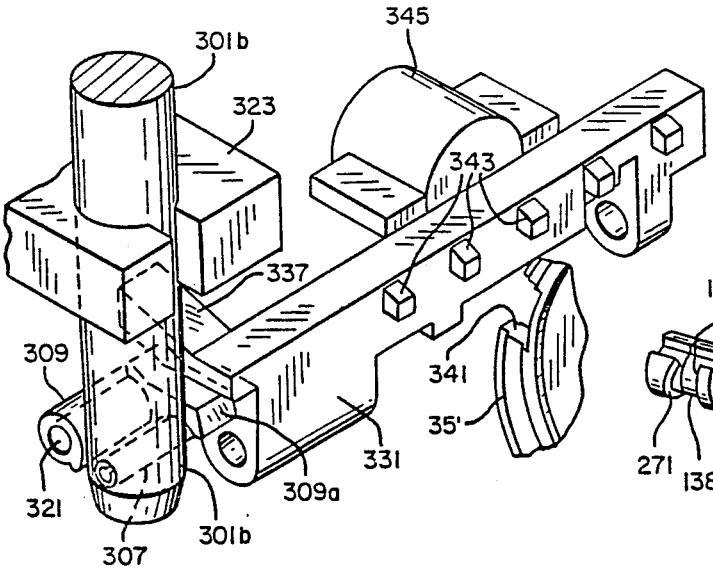
FIG. 19
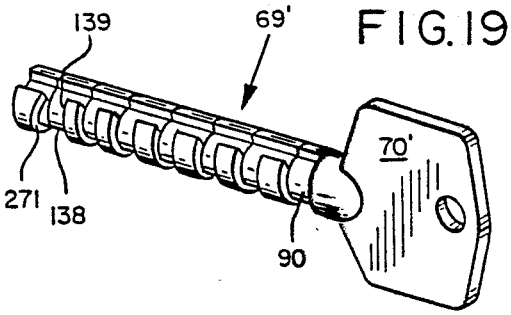

KEY

RELATED APPLICATION DATA

This application is a continuation of copending application Ser. No. 709,583, filed Mar. 8, 1985, which in turn is a continuation-in-part of application Ser. No. 706,710, filed Feb. 27, 1985, now abandoned, which in turn is a continuation-in-part of application Ser. No. 661,085, filed Oct. 15, 1984, now abandoned. The disclosure of parent application Ser. No. 709,583 is incorporated herein by reference.

BACKGROUND AND SUMMARY OF THE INVENTION

This invention relates to a key for a lock apparatus.

A preferred form of the invention relates to a key used in a lock that is opened not only by use of the key but also by the manual entry of a combination.

Lock mechanisms incorporating both key operation and combination operation are old. An early patent to Raab, U.S. Pat. No. 1,389,380, shows a lock mechanism in which the combination or permutation mechanism needs to be operated to enable the lock to be opened by the key.

U.S. Pat. 1,937,523 to Machinist shows a lock in which the combination must be first dialed into the combination mechanism before a key can be inserted to open the lock.

A later version of the above locks is the one shown in U.S. Pat. No. 3,383,886 to Herman, in which the key is first inserted and then the combination dial operated to enable the key to be turned. Thereafter, the dial must be further turned in order to open the lock.

A more recent patent to Hutchins, U.S. Pat. No. 4,416,337, shows a lock mechanism having a key and a combination lock comprising three or more dials.

In German Patent No. 1,428,526, combination dials are first moved coded distances, and then a coded key is inserted to move the wheels further distances to effect opening of the lock.

The design of the German lock and key is such that the lock can be opened by differently coded keys, provided that the combination discs or dials are moved amounts related to the code of the particular key used.

U.S. Pat. No. 4,325,240 to Gable shows a lock much like the one in the German patent, but having the reverse sequence, i.e., the key is inserted first, and the coded combination is thereafter dialed in. The Gable patent, like the German patent, can be opened by differently coded keys provided that the combination dialed in is related to the particular key used.

It is evident from the above that in both the German patent and the Gable patent one stage of coded input is effected by rectilinear insertion of a flat coded key.

A main object of the present invention is to provide an improved key for a key/combination lock.

Another important object of the invention is to provide a uniquely shaped key for a key/combination lock so designed that a uniquely shaped key is required to open it, whereby duplication of the key is made difficult.

Another object of the invention is to provide a key of a unique cylindrical form, rather than flat form, as in the German and Gable patents, making it difficult to duplicate.

Another object of the invention is to provide a key/combination lock in which the turning movement of a key, rather than rectilinear movement, is utilized to effect one stage of coded movement of combination dials.

The present invention provides a key/combination lock in which two stages of movement of turnable elements are necessary to open the lock, one stage of movement being effected by insertion and turning of a key, while the second stage of movement is effected manually. The present invention also provides a cylindrical key for opening the above lock.

The lock of the present invention preferably incorporates a recording feature. That feature is per se not new, being shown, for instance in patents to Knistrom U.S. Pat. No. 1,253,051, De Vines U.S. Pat. No. 3,438,0-51 and U.S. Pat. No. Gable 4,325,240.

Another object of the invention is to provide a lock mechanism of the coded wheel type having a specially designed key which cannot only turn the wheels coded distances but also can actuate a recording mechanism.

A further object of the invention is to provide a lock and key arrangement as just recited above wherein there are sequencing means for controlling the sequence of operations to assure, among other things, that the lock cannot be unlocked without recording the identity of the key used to enter the lock.

A still further object is to provide a key for a lock of the type just recited above that participates in the sequencing operations.

The concept of recording the identity of the specific key used in opening a lock is ideal for the lock box industry in which a key container within the lock box is releasable upon proper operation of a series of coded wheels so as to enable the user to remove a stored "access" key from the container for use in gaining access to another structure.

It is another object of the invention to provide a lock box/key holder unit having a latch for releasably retaining a key container in place, an exterior release button for releasing said latch, a series of coded wheels preventing actuation of the button until the coded wheels have been turned to predetermined positions, a recording mechanism operable when actuated for recording predetermined positions of the coded wheels, and a sequencing means for preventing actuation of the button until the sequencing means has been actuated by a key, the sequencing means also participating in the actuation of the recording mechanism.

It is a still further object of the invention to provide a key which not only turns the coded wheels but also can actuate other decides in the lock and particularly to provide a key in which turning movement of the key turns coded wheels, but wherein the key by its design is permitted to subsequently move rectilinearly for actuating certain devices; and is also so formed as to be capable of resetting at least part of the sequencing mechanism as the key is retroturned.

Various other objects of the invention will be apparent from the following description taken in connection with the accompanying drawings wherein:

FIG. 15 is an enlarged view of the case shown in FIG. 14;

FIG. 16 is a perspective view of a sequencing wheel and rocker lever and certain associated parts;

FIG. 17 is a view like FIG. 16, but showing a different position of the parts;

FIG. 18 is a perspective view of the shackle release bar and related parts;

FIG. 19 is a perspective view of a key of the invention;

DESCRIPTION OF THE PREFERRED EMBODIMENT

Figure 1:
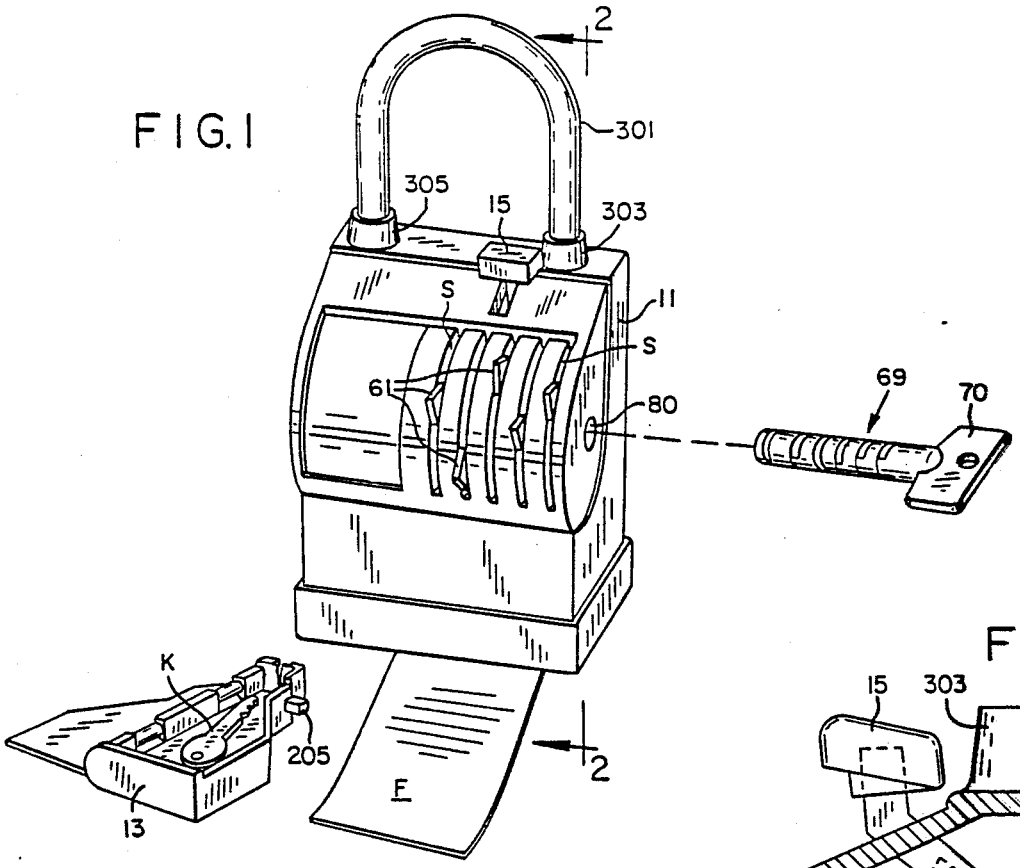
FIG. 1 is a perspective view of a lock mechanism of our invention.
Figure 2:
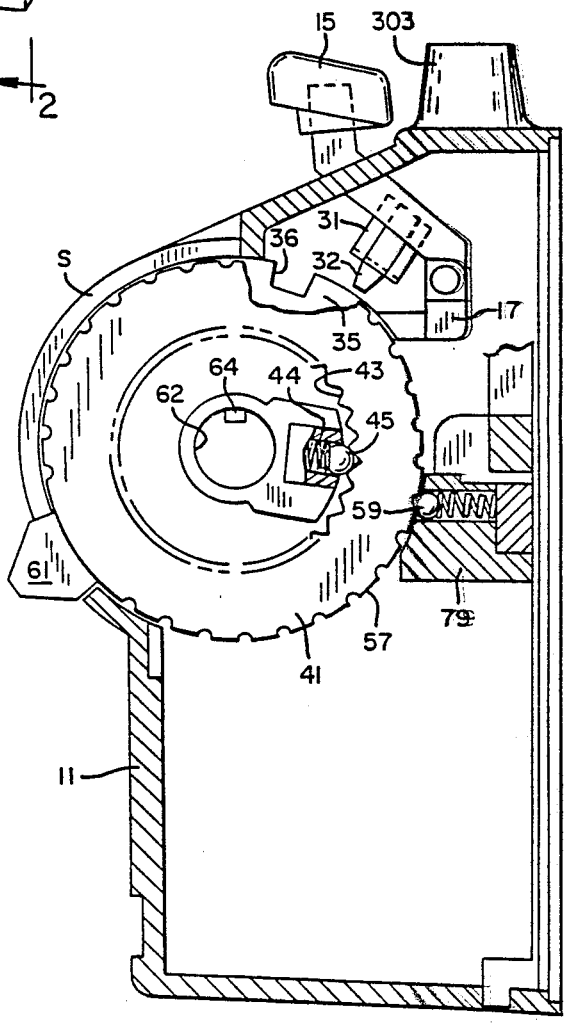
FIG. 2 is a cross sectional view taken along lines 2—2 of FIG. 1.

Referring primarily to FIGS. 1 and 2, our invention includes a housing or case 11, in which a key/combination mechanism of the present invention is incorporated. The case 11 has a container or pouch 13 for holding an "access" key . This access key is to be used in permitting access to another device or structure. The overall arrangement is such that when an actuator 15 is depressed, it pivots a lever 17 to release a latch (to be later described), enabling the container 13 to be removed so as to make available use of the access key.

Actuator 15 cannot normally be depressed because it has a stop member 31 (FIGS. 2–5) which has a series of pins 32 disposed close to the peripheries of a series of code discs 35. This stop member and associated pins prevent depression of actuator 15 at all times, except when a series of notches 36 in the code discs are brought into alignment with one another and into register with pins 32.

Figure 7:
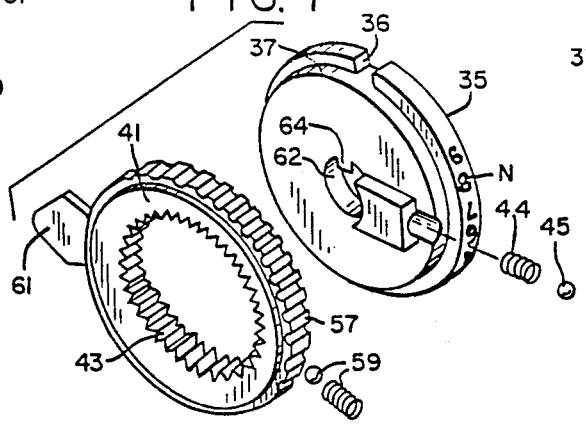
FIG. 7 is a perspective view of the key, a ring, a code disc, and certain related parts.

Each code disc 35 (FIG. 7) is formed on one of its faces with a hub 37 on which is turnably mounted a combination ring 41. The combination ring 41 is internally serrated at 43 to receive a spring biased detent 45 carried by the hub portion 37 of the associated code disc 35. The exterior of each combination ring 41 is formed with a series of outer serrations 57. Each series of outer serrations receives a spring pressed detent 59 (FIGS. 2, 7), one being provided on case 11 for each combination ring. Each combination ring 41 is also formed with a projecting contacting element or tab 61 by which the ring may be turned by finger contact.

Figure 21:
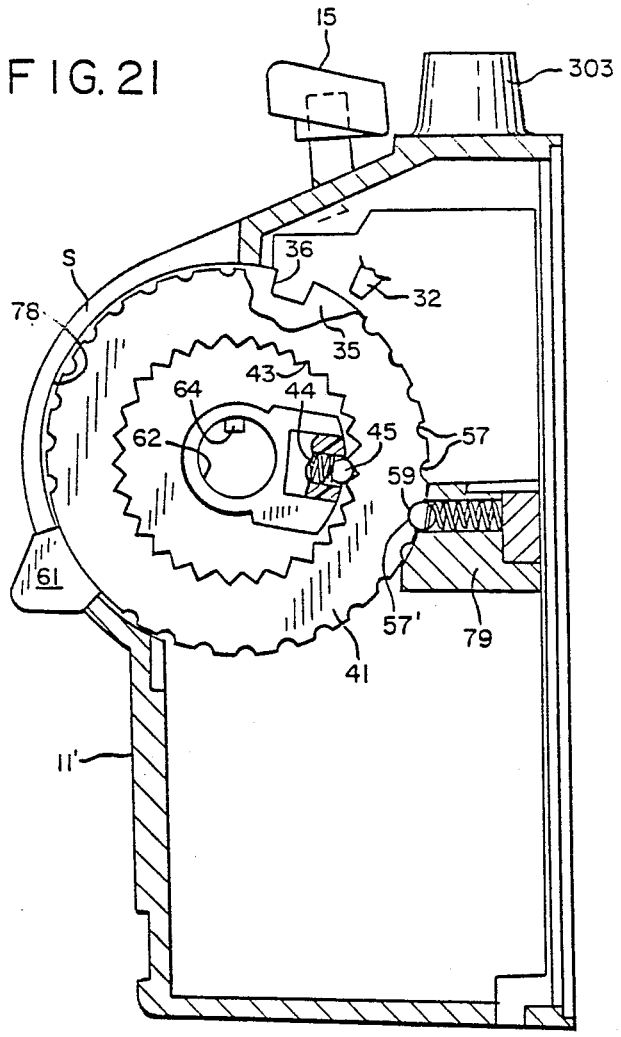
FIG. 21 is a sectional view like FIG. 2, but showing the FIG. 14 arrangement.
Figure 22:
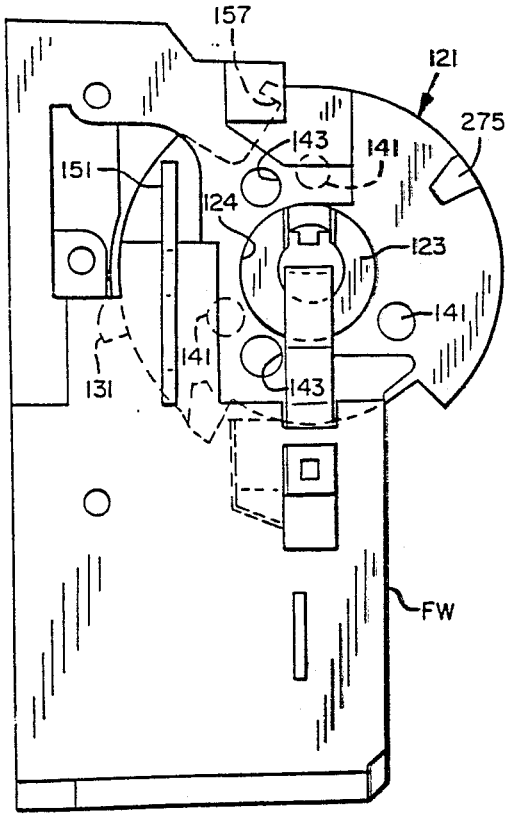
FIG. 22 is a side elevational view of the interior assembly, taken from the side thereof, as regards FIG. 15, remote from the keyhole.

Code discs 35 are desirably in sliding but rotary contact with the bulging front portion 78 of the case and a cross member 79 (FIG. 21) of the framework FW. Front portion 78 and cross member 79 thus turnably support the code discs, and therefore the combination rings 41, within the case.

Each code disc 35 is formed with a central bore 62 (FIGS. 2–5, 7) which is circular except being interrupted by a keying lug 64. Hereinafter the keying lug will be called an "internal" lug because of the many other uses of the term "key" herein.

Figure 8:
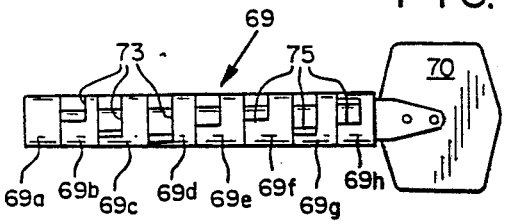
FIG. 8 is a side view of a key of the present invention.
Figure 10:
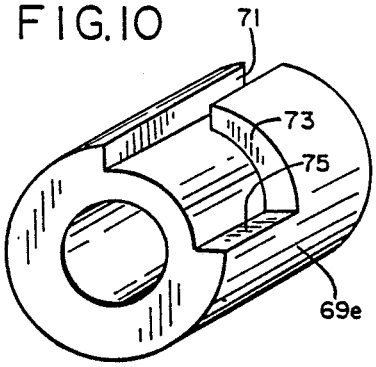
FIG. 10 is a perspective view of an operating segment of the key.
Figure 9:
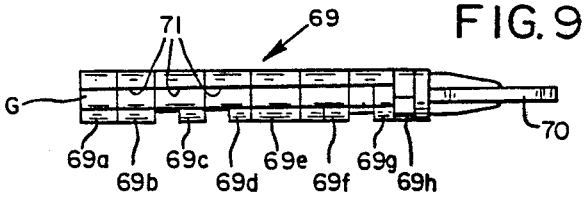
FIG. 9 is a view of the key taken 90 degrees from that in FIG. 8.
Figure 11:
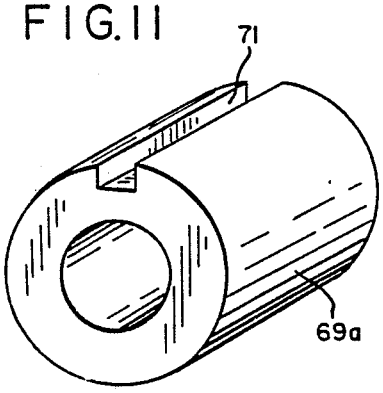
FIG. 11 is a perspective view of the free end segment of the key.
Figure 13:
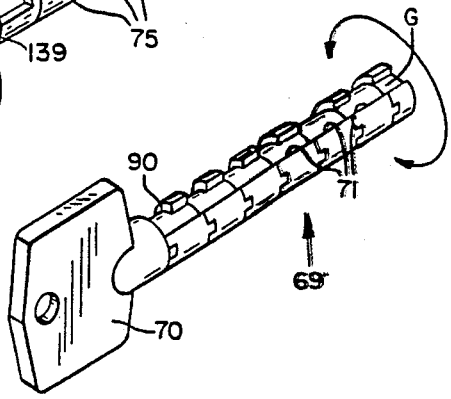
FIG. 13 is a view like FIG. 12, but taken from the opposite end and side.

A cylindrical key 69 (FIGS. 8–13) is shown as being made up of a plurality of cylindrical segments, labeled **69*a*–69*h* in FIG. 8, preferably permanently bonded or otherwise secured in end-to-end relationship. A handle portion 70 is desirably secured to key segment 69*h*. Each of the segments is formed with a longitudinal groove 71 (FIGS. 9–11) which extends completely through each segment except for segment 69*h*, where it stops just short of the right hand end face of the segment. For convenience, the letter G will be used to designate the composite groove made by the end-to-end disposition of the grooves 71 of the various segments. If desired, segment 69*h*** can be made an integral part of the shank of the key.

Each of the segments, except for segment **69*a*, is formed with a circumferential groove 73 (FIG. 10) terminating in a stop shoulder 75**, the shoulders being differently circumferentially located about the axis of the key in accordance with the code of the key. The particular disposition of the shoulders shown in the drawing represents only one overall code. It is, of course, contemplated that the lock mechanism will be accessed by a number of keys of the same general type, but having different codes.

The composite groove G is of a size to slidably receive the internal lugs 64 on the code discs, the code discs having such lugs in alignment at the time the key is inserted into the lock. Desirably, case 11 has a key hole 80 (FIG. 1) for receiving the key.

(While the foregoing discussion has focused on a key made of a plurality of segments, it will be recognized that the key can likewise be formed by machining a unitary cylindrical body.)

OPERATION

Figure 3:
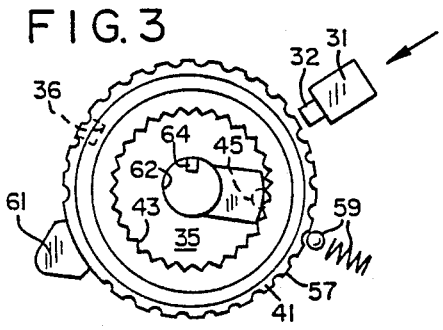
FIG. 3 is a face view of a disc/ring unit, the figure also showing certain related components, with the part shown in the position they assume in the locked condition of the lock.
Figure 4:
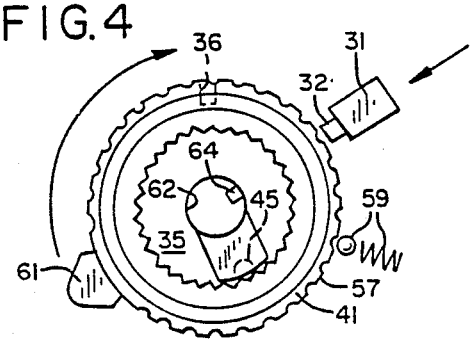
FIG. 4 is a view like FIG. 3 but showing the key having been turned to dispose the lock in its unlocked condition.

At the time key 69 is inserted, the parts are in the positions shown in FIG. 3. Key 69 is then turned clockwise to bring key shoulders 75 into selective contact with the internal lugs 64 of the code discs 35 and to selectively turn the code discs relative to combination rings 41, by amounts determined by the circumferential disposition of the various shoulders on the key. This movement locates the various notches 36 on code discs 35 in intermediate positions of movement, which may be considered the positions they assume after a first stage of movement (FIG. 4).

At this point, the notches 36 in code discs 35 have not yet been moved far enough to be brought into alignment with one another, nor into proximity with stop member 31.

Figure 5:
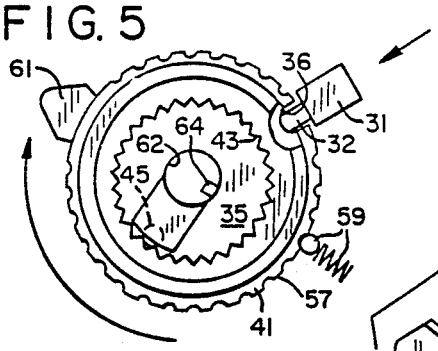
Figure 6:
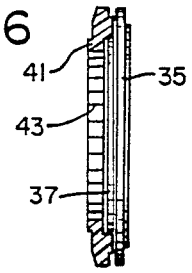
FIG. 6 is an edge view, partly in section, showing a disc/ring unit.

At this point, a person knowing the code combination related to the particular key being used can turn the combination rings 41 by finger contact with the contact elements or tabs 61 in accordance with the code. Such movement of the combination rings 41 moves the associated code discs 35 a second stage of movement. If the proper code combination has been entered by manual movement of the combination rings, this second stage of movement causes the notches 36 in the code discs 35 to move into alignment with one another and into register with the pins 32 of the stop member 31, as shown in FIG. 5.

With notches 36 so aligned by the second stage of movement, actuator 15 (FIGS. 1, 2) can be depressed to open the case to enable removal of the access key K. Preferably, however, a rocker latch (to be described) is provided to prevent depression of the actuator 15 until such time as the identity of the key has been recorded.

It should be pointed out that the pressure applied by the outer detents 59 from the case 11 to the outer serrations 57 on the combination rings 41 exceeds the pressure applied by the inner detents 45 from the code disc hub 37 to the interior serrations 43 in the combination rings. Turning movement of code discs 35 under the influence of the key thus causes inner detents 45 to pop in and out of the internal serrations 43 on combination rings 41, without moving the outer serrations 57 on the combination rings relative to the outer detents 59.

It should be further pointed out that the finger contacting elements or tabs 61 on the combination rings 41 project through a series of slots S formed in the case 11 (FIG. 1) so as to expose the peripheries of the combination rings, but not the peripheries of the code discs 35 and their notches 36, which are thus concealed.

In one embodiment, after key container 13 has been reinserted back into case 11, the finger contacting elements 61 are manually returned to their zero positions. This movement carries code discs 35 and associated combination rings 41 to their FIG. 4 positions. The key is then turned in a retro direction so that the shoulders provided by keg groove G successively engage the internal lugs 64 of the code discs 35 so as to move the code discs relative to the combination rings and return the code discs back to their original positions (FIG. 3). In this original coded position, internal lugs 64 are in alignment with the axially extending groove G in the key 69. The cylindrical key is then removed, leaving the lugs aligned and conditioning the lock for properly receiving the key at a later time.

If desired, a recorder can be built into the lock mechanism. For instance, the periphery of each code disc 35 can be provided with a series of numbered projections N (FIG. 7), which, together with an imprinting mechanism, can indicate the code of the key used in opening the lock mechanism. The imprinting mechanism may be actuated by the actuator 15 or it may be actuated by forming a set of longitudinal grooves on the key to enable the key, after it has been turned to its fully operative position, to be forced axially inwardly against spring resistance to trip an actuator for the recording mechanism.

Figure 12:
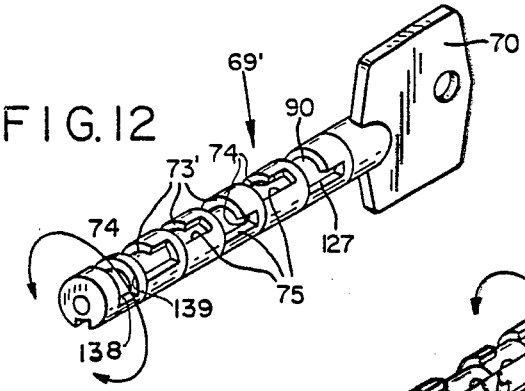
FIG. 12 is a perspective view of a modified key.

FIG. 12 shows a modified key in which the grooves 73' are of bayonet shape to provide longitudinally extending portions 74. These portions permit the key, after having been moved through the first and second stages of movement, to be pushed axially inward so as to trip an imprinting pad mechanism associated with the numbered edges on code discs 35. A foil, shown in FIG. 1, is interposed between such numbered edges N (FIG. 7) on the code discs and is pressed by the imprinting pad mechanism against the numbered edges to mark the foil and thus identify the key used.

Figure 14:
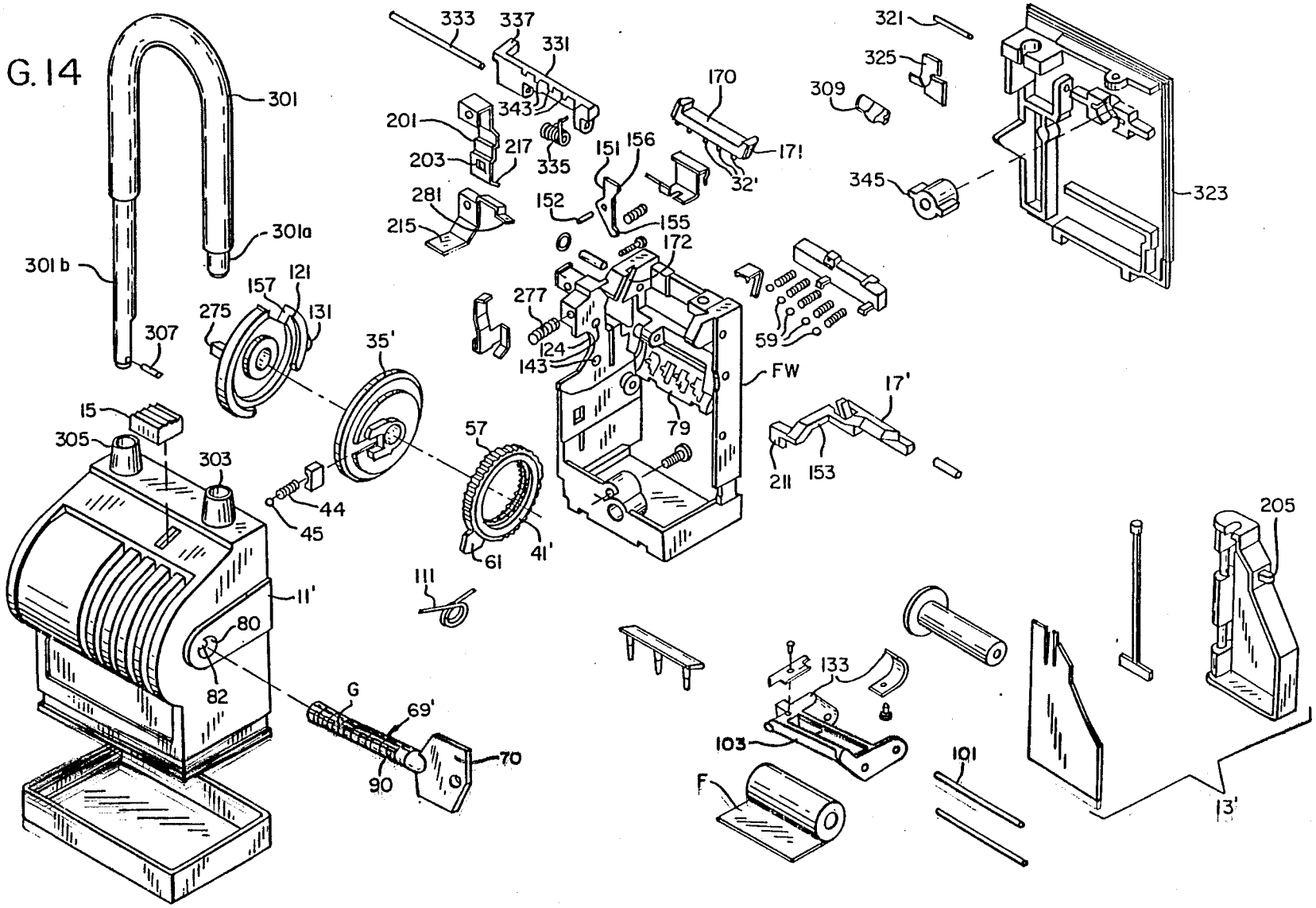
FIG. 14 is an exploded view of a key/combination lock incorporating a recording mechanism.
Figure 20:
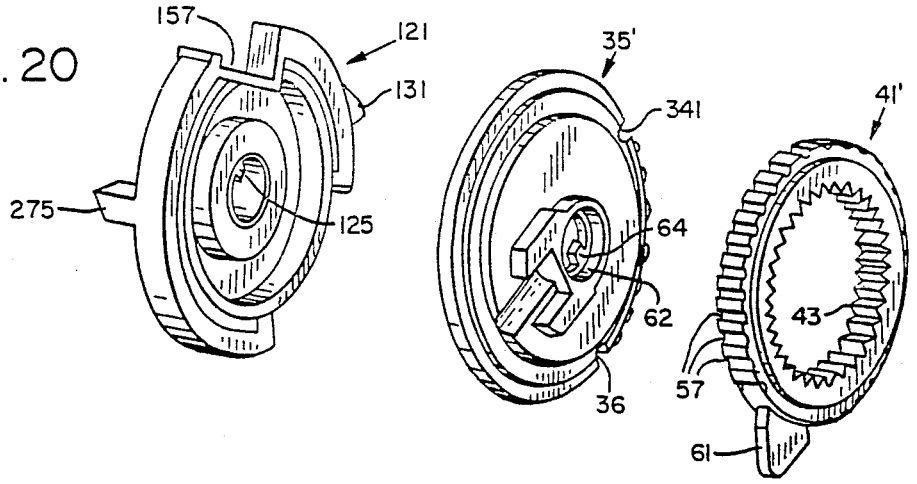
FIG. 20 is a perspective view of certain internal components of the lock.

Now turning to FIGS. 14 et seq., these figures show structure which adds to and/or in some instances revises that shown in FIGS. 1–13.

Referring to FIG. 14, the case 11' is essentially the same as the case 11 in FIG. 1. One difference is that case 11' has an orienting lug 82 at the key hole 80. This orienting lug is of a width to slidably fit in the key groove G at the time the key 69' is inserted into the lock.

Key groove G initially orients the key relative to the case and, more importantly, orients the key relative to certain internal components of the lock as will become evident. Key groove G also determines the return positions of such internal components at the time the key is retroturned to a position where it can be withdrawn from the lock.

It is pointed out that the key 69' (FIGS. 12–13), like key 69, is formed with plural circumferential grooves 73'. In key 69', the groove 90 closest to the handle, is wider than the other grooves 73' because the orienting lug 82 is longer (in an axial direction) than the internal lugs 64 of the code wheels. This feature requires that the key be fully inserted into the lock before it can be turned.

Another difference between the structure in FIGS. 1–7 and that in FIGS. 14 et seq., lies in the detenting arrangement between the exterior of the combination rings 41' and the case 11', on the one hand, and the interior of the combination rings and the code disc hubs, on the other.

The springs 44 (best shown in FIG. 21), biasing inner detents 45 against the inside of combination rings 41' are so proportioned, in the structure in FIG. 14, that the pressure applied to the inner detents is normally strong enough to carry the combination rings 41' with the code discs 35 as the code discs are turned by the key. However, each combination ring 41' is provided with a deep external serration 57' (FIG. 21) at its zero position into which the corresponding outer detent 59 fits when the combination ring is at its zero position. This arrangement makes it more difficult to move a combination ring 41' from its zero, or rest position than it is at any other time.

It thus follows that when the combination rings 41' are at their zero position, movement of the code discs 35 by the key is insufficient to move the associated combination rings from their zero position. Instead, the turning movement of code discs 35 by the key simply causes the interior detents 45 to ratchet around within the interior of combination rings 41', which are left stationary. That is, the coupling force applied by internal detents 45 from code discs 35 to the interiors of combination rings 41' is insufficient to overcome the resistance force created by the associated external detents 59 fitting in the deep serrations 57'.

On the other hand, once the resistance created by external detents 59 fitting into deep serrations 57' has been overcome, by manually setting or moving the tabs 61 on the combination rings 41' from their zero position, movement of the combination rings is easier. In fact, the relationship is such that in retromovement, turning of the key (which engages internal lugs 64 of code discs 35) not only moves the code discs in a resetting direction, but causes the code discs to carry with them the associated combination rings, with the external detents 59 now ratcheting in and out. Thus, retroturning of the key resets both the code discs 35 and combination rings 41' to their zero positions.

As previously mentioned, it is contemplated that a recorder can be built into the lock mechanism. Recording locks in general are known in the art, as cited earlier. Our particular implementation of the recorder, however, including the actuator used therewith, is believed novel and is shown in FIGS. 14 et seq.

A printing head 103 (FIG. 26) is tiltably supported on a shaft 101, which in turn is supported by the framework FW. The printing head 103 has incorporated in it a foil-advancing mechanism (of known construction) which is actuated each time the printing head is actuated so as to advance a sheet of foil F trained about the printing head. This incremental advancement insures separation of the information recorded on the foil by successive operations of the lock.

Insofar as actuation of the printing mechanism is concerned, it was previously mentioned that the imprinting mechanism might be actuated by the actuator 15, or that the parts might be so arranged that the key could trip an actuator for the recording mechanism.

Figure 23:
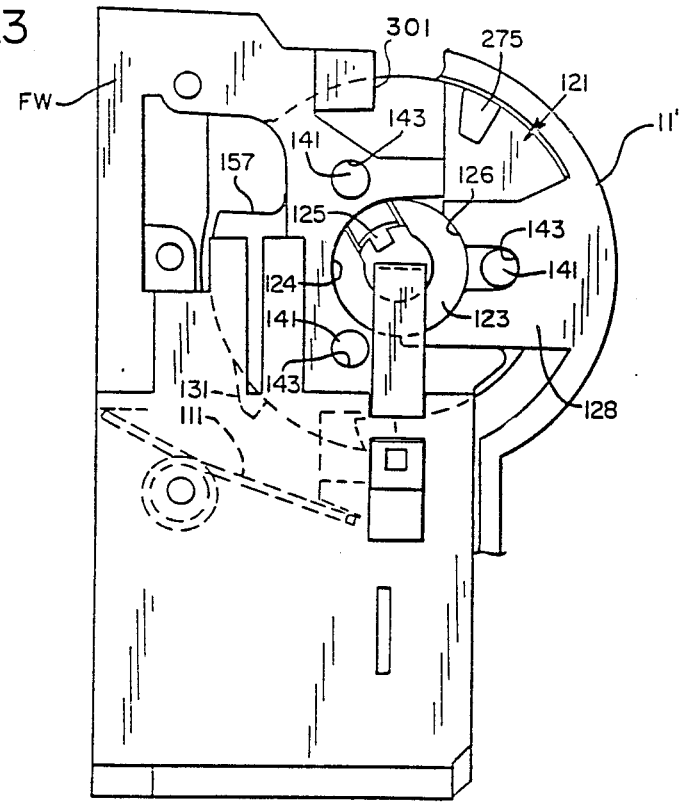
FIG. 23 is a view like FIG. 22, but showing a different stage of operation.
Figure 24:
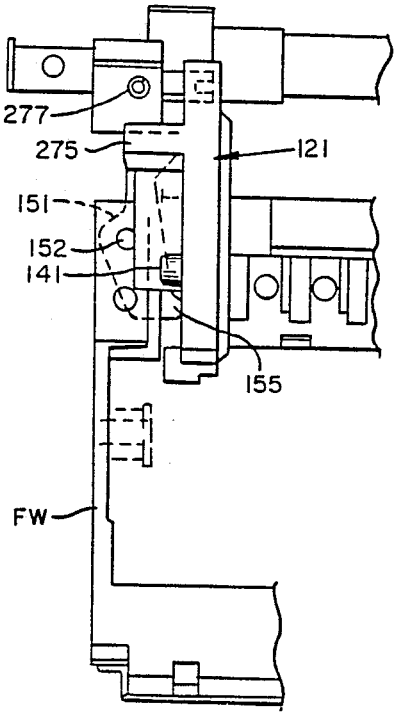
FIG. 24 is a front fragmentary elevational view of the interior assembly, corresponding to the FIG. 22 stage of operation.
Figure 25:
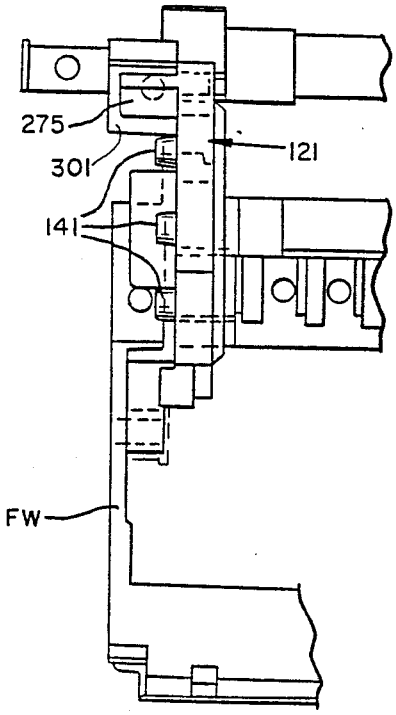
FIG. 25 is a fragmentary front elevational view of the interior assembly corresponding to the FIG. 23 stage of operation.

In the FIGS. 14 et seq. form of the invention, it is the key that preferably not only trips the operation of the recording mechanism, but also functions as the actuator. The key first cocks the printing head 103 (FIG. 27) away from the code wheels against the resistance of a torsion spring 111 (FIG. 23). Further movement of the key then trips the cocked head so that it snaps toward the wheels to bring foil F (FIG. 26) into engagement with a line of numbered projections N on the code wheels.

An important feature of the present invention is the provision of a sequencing member 121, which in FIGS. 14 et seq. is in the form of a wheel. Sequencing wheel 121 is not only supported in part by the case and the framework FW, but also has a hub 123 (FIG. 23) rotatably received in an opening formed by a curved notch 124 in a wall of the framework and a curved notch 126 formed in a projecting flange 128 on the case.

Sequencing wheel 121 has an internal lug 125 (FIG. 23) much like the internal lug 64 on a code disc. This lug 125 is engaged by a circumferentially facing shoulder at the end of enlarged groove 138 on the key (FIG. 19). The shoulder is not visible in FIG. 19, but is visible in FIG. 12. (The FIG. 12 key has one more intermediate segment than the one in FIG. 19, so the latter key is distinguished by the prime mark). The engagement between shoulder 138 on the key and lug 125 in the sequencing wheel 121 causes the sequencing wheel to turn during the turning movement of the key. Lug 125 is also an element of the recording mechanism actuator, as discussed below.

Figure 26:
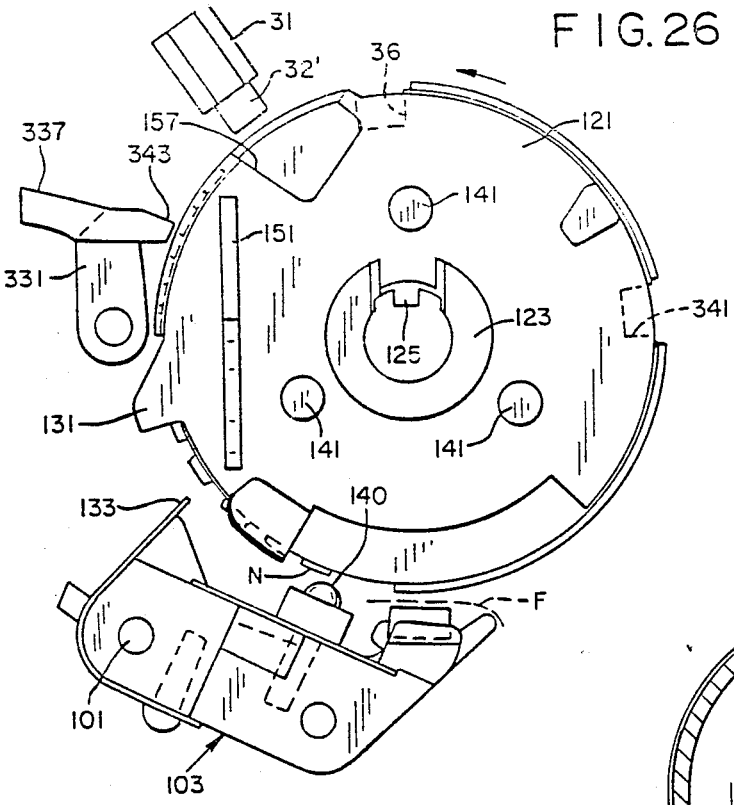
FIG. 26 is a side elevational view of the sequencing wheel and certain associated parts, corresponding to the FIGS. 22 and 24 stage of operation.
Figure 27:
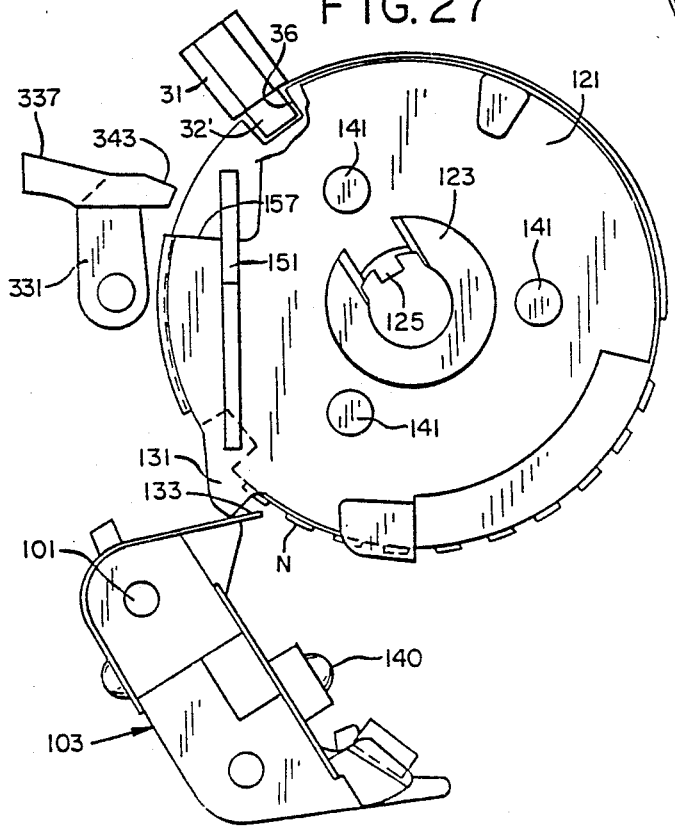
FIG. 27 is a view like FIG. 26, but corresponding to the FIGS. 23 and 25 stage of operation.

At the beginning of a cycle of operation, a peripheral cam 131 (FIGS. 23 and 26) on the exterior of sequencing wheel 121 lies in the same vertical plane as a follower lug 133 (FIG. 26) on the printing head. The arrangement is such that cam 131 will engage follower lug 133 just before the key reaches the end of its forward turning stroke (FIG. 27). This engagement tilts the printing head about pivot point 101 against the resistance of the torsion spring 111 (FIG. 23), moving the head and associated foil away from the peripheries of the code discs. A stop 275 (FIG. 23) on the sequencing wheel 121 engages a stop boss 301 on the framework FW to determine the extent of the forward movement of the sequencing wheel.

Now, as previously pointed out, the key is preferably formed with bayonet slots. However, this is not the case for the outermost groove 138 (FIG. 19). Instead, the groove has an axially directed shoulder 139 which, upon axial movement of the key, engages internal lug 125 of the sequencing wheel 121 and shifts the sequencing wheel axially inwardly so as to misalign cam 131 and follower 133. This allows the printing head 103 to snap back (FIG. 26) to its rest position impacting the foil F on the line of numbers N on the coded wheels opposite the bumper 140 to thus identify the key used in opening the lock.

The sequencing wheel 121 is provided with several sequencing pins 141 (FIGS. 16, 17 and 23), while the opposing wall of the framework FW and the flange 128 are provided with matching holes 143 (FIG. 14). Holes 143 are located so that sequencing pins 141 cannot enter the holes until the key has been turned as far as it can be turned (at which time the printing head 103 is fully cocked and the code wheels 35 have been fully moved as far as the key can move them, compare FIGS. 26 and 27). Thus, sequencing pins 141 assure that printing head 103 cannot be released until the code discs have been moved to their fully coded first stage positions.

A further feature of the sequencing wheel is that there is a rocker latch 151 (FIGS. 14, 16 and 17) tiltably mounted at 152 in a slot in the framework. Latch 151 has an upper arm normally in a blocking position just below the horizontal leg portion 153 of the lever 17 (FIGS. 14, 28) which connects to button 15. Thus, while the key can be turned to set code discs 35 to their first stage coded positions, and while tabs 61 can be moved to further move the coded wheels to align the notches 36 with the pins 32, the button 15 cannot be depressed because of the present of the rocker latch 151.

The lower arm of the rocker latch 151 has a toe 155 (FIG. 17) projecting towards the associated side of the sequencing wheel 121, while the upper arm has a toe 156. These toes extend toward sequencing wheel 121, but terminate just short of it, in the unshifted position of the wheel (FIG. 16). Sequencing wheel 121 has a section removed, as is evident from the drawings, so as to leave a clearance notch 157 in the wheel.

It is evident from the above description and drawings that the two toes 155, 156 on the rocker latch 151 would prevent axial shifting movement of the sequencing wheel 121 were it not for the notch 157. That is to say, when the sequencing wheel is properly turned by the key to the FIG. 17 position, the notch 157 will come into alignment with the upper toe 156, whereafter the sequencing wheel can be shifted to the left engaging the lower toe and rocking the rocker latch. This movement of the rocker latch permits depression of the actuator 15 insofar as the rocker latch 151 is concerned.

Framework FW is provided with a spring pressed detent (obscured by rocker latch 151 in FIGS. 16 and 17) which engages a hole 160 in the rocker latch. These parts are arranged such that when sequencing wheel 121 is axially shifted to rock rocker latch 151, the detent will snap into the hole 160 and releasably hold the rocker latch in its inoperative position, i.e., in a position where its upper arm no longer blocks depressing movement of the actuator 15.

It is evident from the above discussion that the sequencing wheel arrangement is another safeguard to prohibit release of the container or pouch or key holder 13' until after the identity of the key has been recorded. That is, rocker latch 151 prevents release of the key holder until after the recording operation has taken place.

Figure 28:
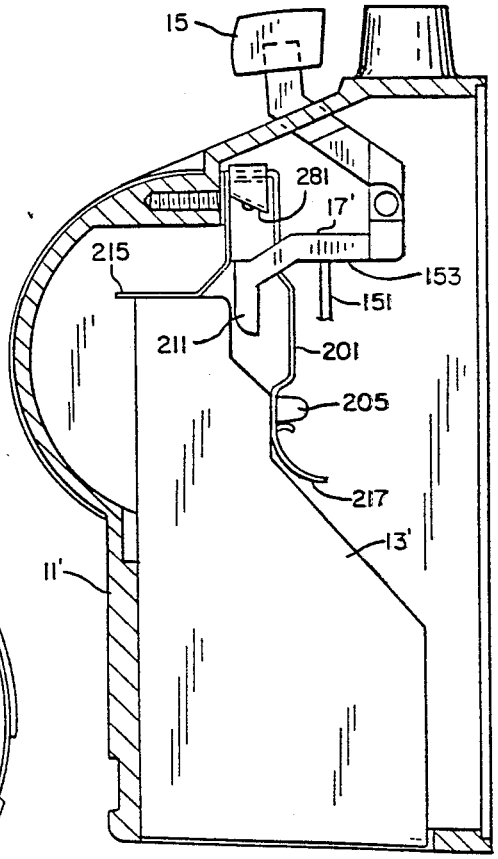
FIG. 28 is a vertical cross section of the case, showing the key holder and certain associated parts.

It will be recalled that in the form of the invention disclosed in FIGS. 1–13, a lever 17 was provided for releasing the key holder 13 that lever 17 was coupled to the series of pins 32 which engaged the notches 36 in the code discs 3 when the code discs were properly aligned. In the FIG. 14 et seq. embodiment, in contrast, the pins 32' are not carried directly by the lever 17' (FIG. 28). Instead, there is a pin-carrying bar 170 (FIG. 14) having guides 171 fitting in ways 172 formed in the framework, there being a leaf spring urging the pin-carrying bar upwardly. When the lever 17' is depressed, it depresses the pin-carrying bar 170 which moves rectilinearly down its ways 172 with its pins 32' moving toward the primary notches 36 (FIGS. 26 and 27) of the code wheels.

KEY HOLDER

The key holder 13' is releasably retained in the case, with its base flush with the bottom of the case, by a spring leaf latch 201 (FIG. 28), mounted on the case and having a hole 203 (FIG. 14) to receive a latch pin 205 (FIG. 28) on the holder 13'. The latch 201 is mounted on the framework FW, to extend downwardly in cantilever fashion.

The horizontal leg 153 (FIG. 28) of the lever 17' has a finger portion 211 disposed behind the latch 201. After the sequencing wheel 121 has been axially shifted to inactivate the blocking rocker latch 151 and the levers or tabs 61 have been properly activated, the lever 17' can be actuated to cause the finger 211 to deflect the latch 201 away from the latch pin 205 to free it. This allows a biasing spring leaf 215, mounted on the framework to push the key holder downwardly, exposing its base. In addition, the lower end of the latch 201 is curled at 217 so as to exert a separating thrust on the holder, via the pin 205 (after the pin has been freed from the latch).

Thus, the key holder 13' is freed and its access key K can be used for its intended purpose, replaced, and the holder pushed back into the case. As this is done, the latch pin 205 will engage the curl 217 to deflect latch 201 enough to allow the holder to be fully reinserted, at which time the latch pin 205 automatically reenters the hole 203 to latch the holder 13' in place within the case.

Relocking of the lock is accomplished by retroturning the key. The key shown in FIG. 19 has a camming shoulder 271 formed on it, so that during the first increment of its retro movement, the cam engages the internal lug 125 on the sequencing wheel 121 and cams the sequencing wheel axially, away from the adjacent framework so that the sequencing pins 141 clear the associated holes 143 and enable the sequencing wheel to be retroturned.

It is pointed out that sequencing wheel 121 has a finger 275 (FIGS. 17, 23–25) disposed opposite a spring 277 (FIG. 14) provided on the framework. When the sequencing wheel, during its forward turning movement, is moved far enough to align the sequencing pins 141 with the associated holes 143, the finger 275 will engage spring 277 and apply a retrograde force attempting to turn the sequencing wheel slightly.

This rotational force applied to the sequencing wheel 121 has no function during the forward cycle of operation, but does during the retrograde cycle. That is to say, as soon as the sequencing pins 141 clear the holes 143, the spring 277, because of its pressure on the finger 275, causes the sequencing wheel to turn slightly, to misalign the sequencing pins with the holes. This occurs even prior to turning movement of the sequencing wheel under the influence of the key. Thus, once the pins are free of the holes, they cannot by inadvertence reenter the holes.

When the sequencing wheel 121 is cammed back to its original position by retroturning movement of the key, the sequencing wheel, upon turning movement causes a camming surface 280 on one edge of the notch 157 to engage the upper toe 156 of the rocker latch to cam the rocker latch back to its erect blocking position. This prohibits operation of the actuator 15, and furthermore positions the upper and lower toes of the rocker latch opposite solid portions of the sequencing wheel, rather than adjacent clearance notch 157 (FIG. 26).

A further feature of the FIGS. 14 et seq. form of the invention is a friction drag 281 (FIG. 28) carried on the framework. As shown, the friction drag is a spring leaf that is so mounted and proportioned and positioned relative to the sequencing wheel that it engages the periphery of the wheel and applies a frictional force to it. Its purpose is to prevent the wheel, once the key has been withdrawn, from being moved, inadvertently, from its zero position, as might occur if the lock were knocked about.

SHACKLE CONSTRUCTION

In the form of the invention disclosed in the drawings, the lock is equipped with a shackle 301 by which it may be mounted on a door knob or similar place. Obviously, the lock could be designed for other uses which would not require a shackle.

The illustrated shackle 301 (FIG. 14) has a short leg 301*a* and a long leg 301*b*. The top of the case 11 or 11' has a pair of sockets 303 and 305. Socket 303 is blind, while socket 305 has a hole in the top of the case so that the long leg 301*b* extends down into the case. When the shackle is locked in place, its short leg 301*a* projects down into blind socket 303, so that the lock is securely shackled in place.

At its lower end, the long leg 301*b* carries a latch lug or pin 307 that cooperates with a tilt latch 309 (FIGS. 14 and 18). The tilt latch is rockably mounted by a shaft 321 mounted in bosses on the back cover 323 (FIG. 14) which closes the rear of the case. The shape of the tilt latch is evident from FIG. 18. A leaf spring 325 (FIG. 14) is located beneath the tilt latch 309 and urges the tilt latch to an upright position, with an operative hook portion 309*a* of the latch upright relative to the back cover (although horizontally as the parts are arranged in the drawings).

With the parts so far described, the shackle could be moved upwardly with the latch lug 307 moving the tilt latch out of the way to a point where the short leg 301 is clear of its blind socket, so that the shackle can be pivoted to a position enabling it to be removed from a door knob or other shaft-like support. However, the tilt latch itself is latched in position by a sequencing latch in the form of a cross bar 331 which is pivotally mounted on a shaft 333 (FIG. 14) journaled in bosses on the framework FW. A torsion spring 335 urges the sequence latch cross bar 331 to remain in an erect position, where an overhanging finger 337 (FIG. 18) is disposed in a blocking position preventing tilting of the tilt latch 309 in a releasing direction.

Sequence latch cross bar 331 is provided with a set of projections 343 (FIG. 18) disposed near the periphery of the code discs 35' and in a position to enter a second set of peripheral notches 341 therein, whenever the notches are brought into register with the projections. This occurs when the code discs have been properly moved through their first and second phases of turning movement, first by the key, and then by hand operation of the tabs 61. A release button 345 (FIGS. 14, 18) is exposed on the back cover of the case and projects into the case in contiguous relation to the rear of the bar 331, and above the shaft for the bar.

Now, assume that the code discs 35' have been properly moved so that the projections 343 on the sequence latch cross bar 331 are in register with the secondary notches 341 of the code discs, and the user desires to remove the lock from the door or other support. This is done by simply pressing the release button 345, which pivots the cross bar 331 to move its finger 337 to an out-of-the-way position. This enables the long leg 301*b* of the shackle to be moved upwardly, with the latch pin 307 rocking the tilt latch 309, thereby enabling the pin and shackle to move upwardly until the short leg 301*a* clears its blind boss 303 (FIG. 14). Now, the shackle and case can be pivoted relative to one another to "open" the shackle, enabling separation of the shackle and lock from the shank of the door knob.

Of course, more often, the user will simply want to obtain the access key and use it, while leaving the lock with its shackle in place. However, should he want to remove the lock mechanisms for any reason, he can do so.

Whenever it is desired to remount the shackle, this is readily done simply by aligning the short leg with its blind boss and pressing downwardly on the shackle. The latch pin 307 will again engage the tilt latch 309, but this time, it is immaterial whether or not the release button 345 has been depressed or can be depressed, because the latch bar 331 only prevents tilting of the tilt latch in one direction, i.e., upward movement of the shackle, not downward movement.

Having described and illustrated the principles of our invention with reference to a preferred embodiment, it should be apparent to those skilled in the art that the invention can be modified in arrangement and detail without departing from such principles. Accordingly, we claim as our invention all such modifications as come within the scope and spirit of the following claims and equivalents thereof.

We claim:

1. A key comprising:

an elongate cylindrical member having a longitudinal groove to receive internal lugs of a lock;

said member having circumferential grooves extending from said longitudinal groove and terminating in circumferentially facing stop shoulders displaced coded circumferential distances from said longitudinal groove, said member having a longitudinally extending bayonet groove formed next to at least certain of said stop shoulders to permit axial movement of said key relative to at least certain of said internal lock lugs, each bayonet groove being circumferentially spaced from said longitudinal groove.

2. A key as recited in claim 1 wherein the key has an additional circumferential groove terminating in a circumferentially facing stop shoulder uninterrupted by a bayonet groove to provide an axially facing stop shoulder for engaging an integral lug of a locking element for moving the locking element axially.

* * * * *